US006830045B2

(12) United States Patent
Brock et al.

(10) Patent No.: US 6,830,045 B2
(45) Date of Patent: Dec. 14, 2004

(54) GAS BURNER MODULE FOR A COOKING APPLIANCE

(75) Inventors: Eddie Max Brock, Cleveland, TN (US); Christopher A. Larsen, Dorchester, MA (US); Gerald R. Place, East Ridge, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,649

(22) Filed: Mar. 12, 2003

(65) Prior Publication Data

US 2004/0177840 A1 Sep. 16, 2004

(51) Int. Cl.[7] ..... F24C 3/00

(52) U.S. Cl. ..... 126/19 R; 126/39 R; 126/39 K; 431/354

(58) Field of Search ..... 126/273 R, 39 R, 126/39 E, 39 K, 19 R, 21 R; 431/354, 343, 258, 285

(56) References Cited

U.S. PATENT DOCUMENTS

| | | | | | |
|---|---|---|---|---|---|
| 866,143 | A | * | 9/1907 | Kirk | 126/39 R |
| 1,062,670 | A | * | 5/1913 | Tinnerman | 126/39 K |
| 1,151,188 | A | * | 8/1915 | Kelly | 126/39 R |
| 1,823,460 | A | * | 9/1931 | Methudy | 239/283 |
| 1,908,668 | A | * | 5/1933 | Hollman | 431/286 |
| 3,614,281 | A | | 10/1971 | Ramey | |
| 4,416,249 | A | | 11/1983 | Reynolds | |
| 4,860,724 | A | | 8/1989 | Schlosser et al. | |
| 5,275,555 | A | * | 1/1994 | Goodridge | 431/343 |
| 5,937,846 | A | | 8/1999 | Martin et al. | |
| 6,074,201 | A | * | 6/2000 | Muhle | 431/354 |
| 6,076,517 | A | * | 6/2000 | Kahlke et al. | 126/39 J |
| 6,200,131 | B1 | | 3/2001 | Birch et al. | |

FOREIGN PATENT DOCUMENTS

| | | | | |
|---|---|---|---|---|
| JP | 55-65837 | * | 5/1980 | 126/39 R |

* cited by examiner

*Primary Examiner*—James C. Yeung
(74) *Attorney, Agent, or Firm*—Diederiks & Whitelaw, PLC

(57) ABSTRACT

A cooking appliance includes a gas burner module having a base structure upon which is secured at least a gas burner element and a gas orifice defining member in a predetermined alignment. The base structure is preferably formed from stamped steel. The burner module also preferably includes a gas igniter. The gas burner module is adapted to be mounted to heat an oven cavity of the cooking appliance. With this arrangement, tolerance build-up leading to misalignment between critical components is greatly reduced thereby improving manufacturing and combustion repeatability, as well as enhanced field replacement. In this manner, the cooking appliance will consistently operate within prescribed agency limitations.

30 Claims, 2 Drawing Sheets

GAS BURNER MODULE FOR A COOKING APPLIANCE

BACKGROUND OF THE INVENTION

1. Field of the Invention

The present invention pertains to the art of cooking appliances and, more particularly, to a unitary gas burner module for use in a cooking appliance having a gas oven.

2. Discussion of the Prior Art

In general, cooking appliances utilizing gas burners to perform cooking operations are known in the art. Typically, such gas burners and other combustion components are positioned to radiate heat into an oven cavity within which is located a food item. That is, the gas burner could be positioned below an oven cavity panel or, alternatively, on an oven cavity surface. In either case, burning gas emitted from the gas burner element causes the temperature of the cavity to rise. In this manner, the food item undergoes a desired cooking operation.

In mounting a gas burner in an oven cavity, great concern must be taken in the alignment between the various combustion components, the most critical being the alignment between the gas burner element and a gas orifice. The gas orifice is provided to direct a gas flow having a distinct configuration into the burner element. Certainly, any changes in the configuration of the gas flow can result in improper or incomplete combustion. The configuration of the gas flow is most affected by misalignment of the orifice with respect to the gas burner. In any case, misalignment will cause improper combustion, resulting in greater emissions from the oven and a shortening of the life of the combustion components.

Characteristically, the gas burner and gas orifice are mounted to different structure within the cooking appliance. The mounting arrangement is generally necessitated by design and spatial constraints. Unfortunately, this typical mounting arrangement promulgates misalignment problems, whether in initial factory assembly or field replacement. As such, the efficiency of the oven is reduced and, by extension, so is the service life of the overall appliance.

Based on the above, there exists a need in the art for a cooking appliance employing a gas burner module. More specifically, there exists a need for a gas burner module formed as a single unit having arranged thereon at least the gas burner element and the gas orifice such as to minimize variability between units. In this manner, by-products of combustion exhausted from the cooking appliance will consistently fall within agency specifications.

SUMMARY OF THE INVENTION

The present invention is directed to incorporating a gas burner module into a cooking appliance. That is, a cooking appliance including a cabinet and an oven cavity further includes a gas burner module positioned to radiate heat into the oven cavity. The gas burner module includes a base structure defined by a horizontal planar surface having arranged thereon at least a gas burner element and a gas orifice defining member which are maintained in a predetermined, fixed alignment.

In accordance with a preferred embodiment of the present invention, the base structure is formed from a stamped metal sheet adapted to be positioned inside the oven cavity. The metal sheet includes a plurality of mounting receptacles for securing the gas burner and gas orifice defining member to the base structure. More specifically, a pair of attachment brackets are employed to mount the gas burner element to the base structure, while a separate attachment bracket is utilized for further mounting the gas orifice defining member to the base structure. A gas igniter is secured at the gas burner element, at a position substantially spaced from the gas orifice defining member, to ignite gas flowing through the gas burner element. The module also includes a supply tube having an end fixed at the gas orifice defining member. With this overall arrangement, an integrated gas burner module is defined which can be mounted in a cooking appliance as a single unit, while assuring a desired alignment between the gas burner element and a gas orifice in order to eliminate assembly time variations and to assure efficient gas combustion with consistently low emissions.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
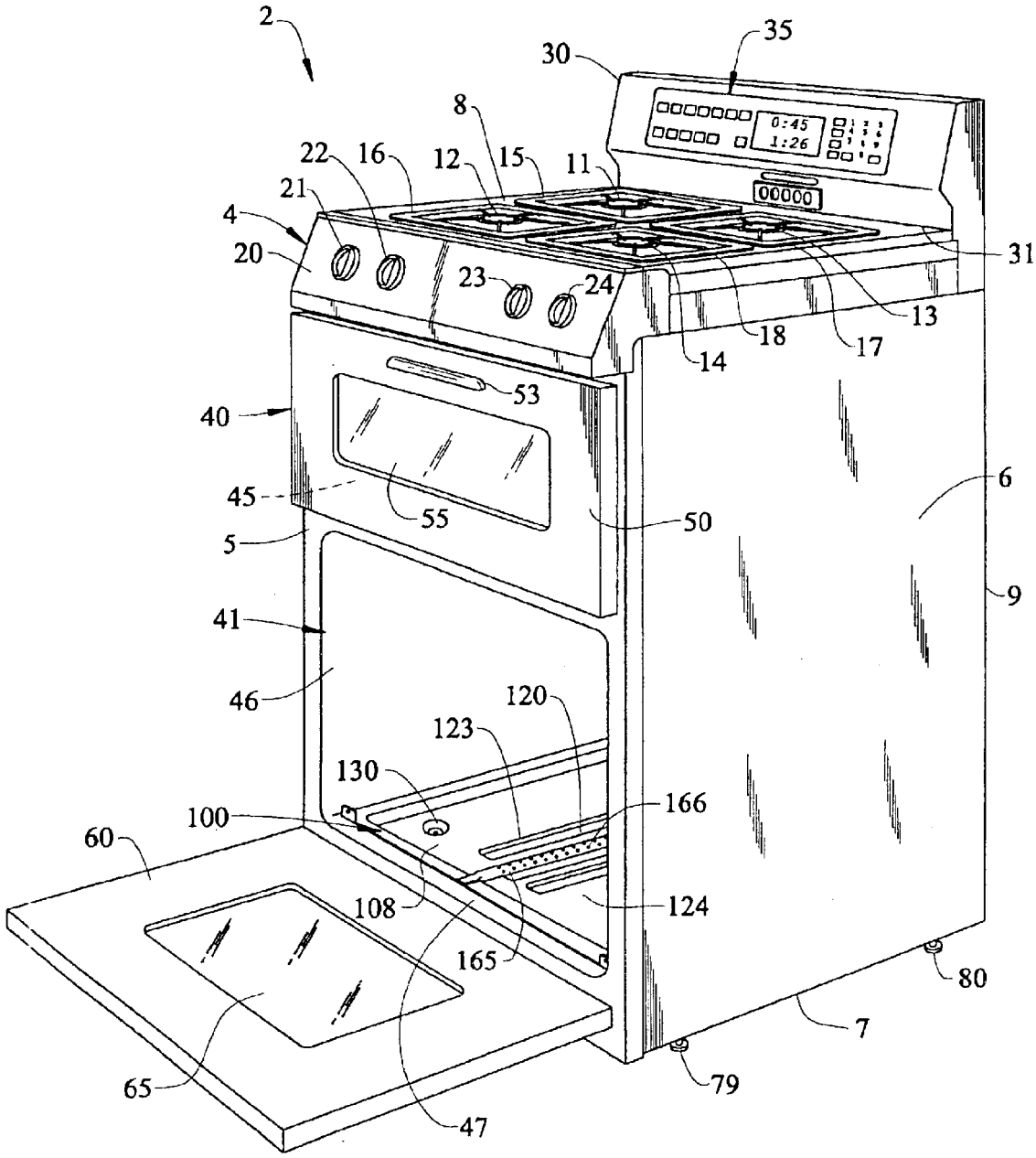
FIG. 1 is a perspective view of a cooking appliance incorporating a gas burner module constructed in accordance with the present invention.

With initial reference to FIG. 1, a cooking appliance incorporating the present invention is shown to take the form of a free-standing gas range unit. Range 2 includes a cabinet 4 having a front panel portion 5, side panel portions 6, bottom portion 7, a range top 8 and main back panel 9. In a manner known in the art, range top 8 can take on various forms.

Specifically, in the embodiment shown, range top 8 is shown as a gas cooktop incorporating various gas burner elements 11–14 and associated burner grates 15–18. As shown, cabinet 4 further includes a front control surface 20. Preferably, control surface 20 supports a plurality of control knobs 21–24 for controlling the activation/deactivation of gas burner elements 11–14 respectively. Furthermore, cabinet 4 includes a rear, upstanding control panel 30 arranged at an upper rear portion 31 of cabinet 4. In the embodiment shown, control panel 30 includes a central control and display unit, generally indicated at 35, for use in controlling first or upper oven 40 and second or lower oven 41.

In a preferred embodiment, upper oven 40 includes a respective first or upper oven cavity 45 and, similarly, lower oven 41 includes a respective second or lower oven cavity 46 having a bottom portion 47. In a manner known in the art, upper oven 40 has associated therewith a door 50 which can be pivoted by means of a handle 53. Door 50 preferably includes a window 55 for viewing the contents of upper oven cavity 45. In a similar manner, lower oven 41 has associated therewith a door 60 and a window 65.

In a manner known in the art, range 2 is adapted to be mounted upon a supporting surface, such as a kitchen floor or the like. More specifically, a plurality of leg members, two of which are indicated in FIG. 1 at 79 and 80, extend from bottom portion 7 at front and rear portions of cabinet 4, along side panel 6. Of course, corresponding leg members are also provided on the opposing side of range 2. In any event, the various leg members 79 and 80 are preferably, vertically adjustable to also act as levelers for range 2. Such type of leg leveler arrangements are widely known in the art of appliances, including ranges and refrigerators, such that the leveling function of leg members 79 and 80 does not form part of the present invention.

In general, the structure described above with respect to cooking appliance 2 is already known in the art and does not constitute part of the present invention. Therefore, this structure has only been described for the sake of completeness. Instead, the present invention is particularly directed to a gas burner module 100 positioned to radiate heat into respective oven cavities 45 and 46.

Figure 2:
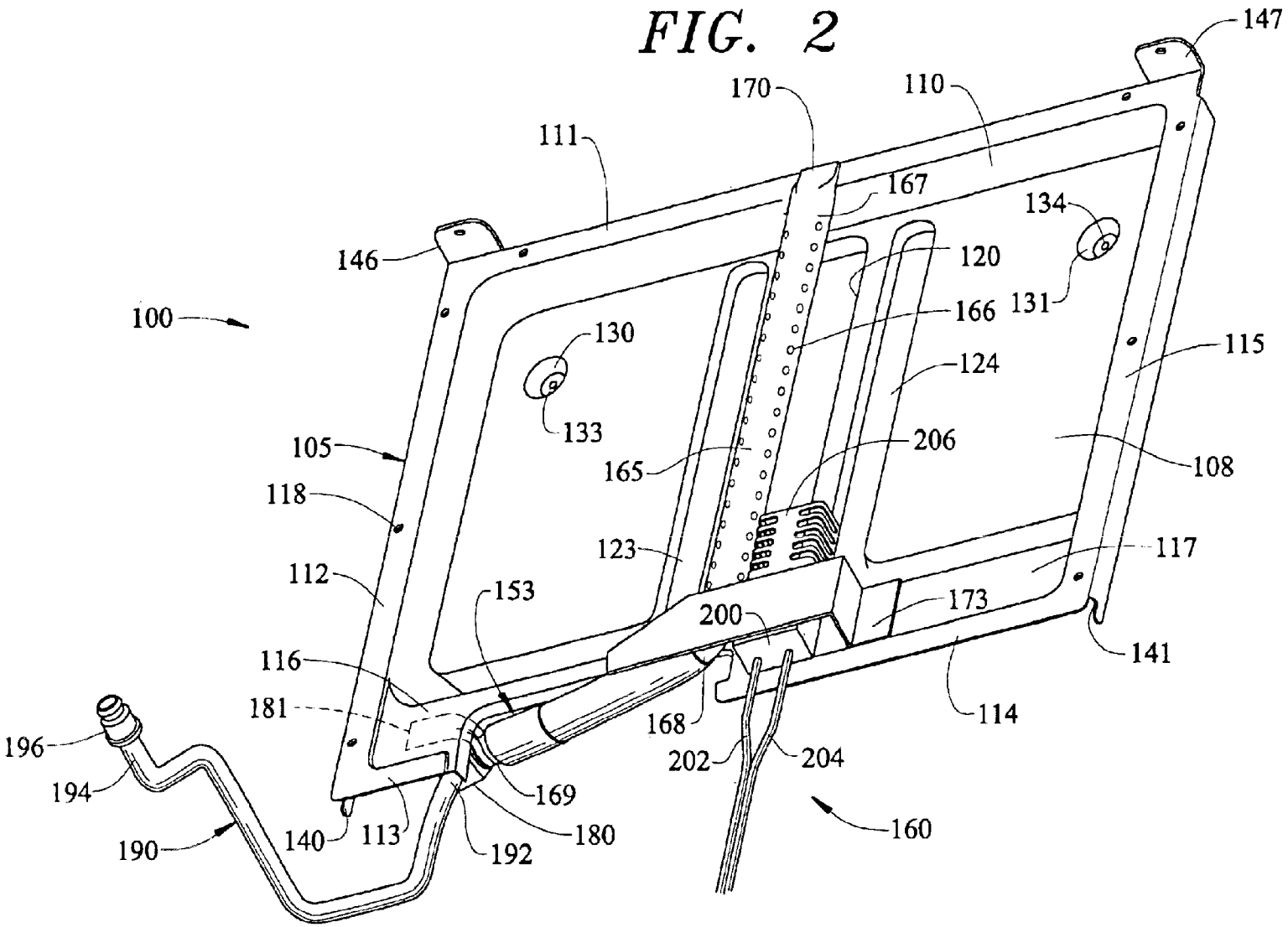
FIG. 2 is a perspective view depicting a top side of the gas burner module of the present invention removed from the cooking appliance of FIG. 1.

Reference will now be made to FIG. 2 in describing the specific structure of burner module 100. Since each oven cavity 45 and 46 includes an associated burner module, and the structure of each burner module is identical, a detailed description of burner module 100 as arranged within oven cavity 46 will be made and it is to be understood that a second burner module (not shown) having commensurate structure is preferably arranged in oven cavity 45.

In accordance with a preferred form of the present invention, gas burner module 100 includes a unitary base member 105 having a central planar portion 108 including a peripheral rim 110 leading to a plurality of out-turned support flanges 111–115. As will be discussed more fully below, positioned adjacent to support flanges 113 and 114 are flat mounting surfaces 116 and 117 respectively. Furthermore, extending about support flanges 111–115 are a plurality of openings, one of which is indicated at 118, for mounting burner module 100 within cooking appliance 2. As shown, central planar portion 108 includes an opening 120 extending longitudinally between support flange 111 and both support flanges 113 and 114. In a preferred form of the invention, generally L-shaped downwardly displaced portions 123 and 124 extend along opposing sides of opening 120 toward rear flanges 113 and 114 respectively. Therefore, adjacent to rear flanges 113 and 114, downwardly displaced portions 123 and 124 turn ninety-degrees and extend toward respective side flanges 112 and 115.

Preferably, insulation package attachment points 130 and 131 are positioned at front corner portions of planar portion 108. Each of attachment points 130 and 131 is preferably stamped into planar portion 108 and includes an associated central bore 133, 134 through which a mechanical fastener can extend to secure an insulation package (not shown). However, it should be understood that a variety of methods for establishing an attachment point could be used without departing from the scope of the present invention.

As will be detailed more fully below, gas burner module 100 is positioned in bottom portion 47 of oven cavity 46 (FIG. 1). Although not shown, a burner box can be arranged below bottom portion 47 for receiving module 100. To secure module 100 in place within bottom portion 47, the laterally outermost portions of flanges 112 and 115 are bent 90° allowing locating notches 140 and 141 to receive a respective oven bottom portion (not shown). On the other hand, tab elements 146 and 147, that extend upwardly from opposing end portions of flange 111, allow mounting of an exhaust flow directing false oven bottom (not shown). In order to facilitate installation and removal of module 100, and enable gas orifice flow adjustments, a cut-out portion 153 is located between flanges 113 and 114. Preferably, cut-out 153 is sized to enable access to a technician's hand, thereby enhancing the ability of the technician to adjust a gas metering orifice (not shown).

As best seen in FIG. 2, a gas burner assembly, generally indicated at 160, is provided as part of gas burner module 100. In accordance with one form of the invention, gas burner assembly 160 includes a gas burner 165, depicted as a burner tube formed with a plurality of exit openings 166 arranged directly opposite opening 120, having a first end 167 extending to an intermediate portion 168 and terminating in a second end 169. More specifically, first end 167 of burner 165 is secured to flange 111 through a first attachment bracket 170 which preferably constitutes a crushed or flattened end portion of gas burner 165, but which could constitute a separate element. Burner 165 is further secured to base member 105 through a second attachment bracket 173 which fastens intermediate portion 168 to mounting surface 117. Preferably, burner 165 is fastened to bracket 173 using a spot weld process, while brackets 170 and 173 are screwed to flange 111 and mounting surface 117 respectively. However, while spot welding is the preferred method of fastening brackets 170 and 173 to burner 165, other methods, including pierce riveting and the like, could be employed.

In accordance with the most preferred form of the present invention, a gas orifice defining member 180 is affixed to an orifice mounting or attachment bracket 181 which, in turn, is secured to an underside of mounting surface 116. Leading to gas orifice member 180 is a gas supply line 190 which also forms part of module 100. More specifically, gas supply line 190 has a first end 192 adjacent gas orifice member 180 and a second end 194 provided with a terminal connector 196 for attaching supply line 190 to a source of natural or propane gas (not shown). Gas burner assembly 160 further includes a gas igniter 200 for igniting a flow of gas emanating from exit openings 166 of burner 165. More specifically, gas igniter 200 is operatively connected to control panel 30 through conductors 202 and 204, such that activation of oven 41 operates igniter 200 to touch off the gas flow from burner 165. In a preferred form, gas igniter 200 constitutes a hot element or glowbar-type igniter and includes a shield 206 which is fixed to burner 165 through bracket 173, wherein shield 206 is adapted to protect igniter 200 from debris falling from oven cavity 46.

With this overall construction, the gas orifice formed in gas orifice member 180 is maintained in a fixed alignment with burner 165. In this manner, assembly line and tooling variability can be maintained at minimum levels. By lowering variability and reducing inconsistencies in the manufacturing process, the manufacturer is able to consistently produce appliances whose emission remain within agency specifications. In addition, ease of field replacement is enhanced. That is, in order to remove burner module 100 from range 2, such as for replacement purposes, a technician simply disengages supply line 190 from a gas source at connector 196, removes screws (not shown) from holes 118 in flanges 111–115, and lifts burner module 100 out as a unit. Obviously, installation of a burner module 100 is performed in a corresponding manner.

Although described with reference to a preferred embodiment of the invention, it should be readily understood that various changes and/or modifications can be made to the invention without departing from the spirit thereof. For instance, the need for a false bottom arranged over the gas module is not paramount. Further, the gas module of the present invention is configurable to be mounted in other gas oven arrangements such that the invention is not limited to dual oven gas ranges. In general, the invention is only intended to be limited by the scope of the following claims.

What is claimed is:

1. A gas cooking appliance comprising:

an oven cavity including at least top, opposing side and back surfaces; and a gas burner module including a base, a gas burner element including a gas inlet portion and a plurality of exit openings arranged along a surface of the gas burner element, and a gas orifice defining member having a gas orifice adapted to receive a flow of gas from a gas source, each of said gas burner element and said gas orifice defining member being fixedly secured to the base in a manner which maintains a desired alignment between the gas burner element and the gas orifice for efficient combustion of gas.

2. The cooking appliance according to claim 1, wherein the cooking appliance constitutes a range including a cabinet having at least a front portion, opposing side panels, a base portion and a back panel, with said cabinet being adapted to rest upon a supporting surface.

3. The cooking appliance according to claim 2, wherein the range includes upper and lower oven cavities, as well as a plurality of surface heating elements.

4. The cooking appliance according to claim 1, further comprising: a gas igniter secured to the gas burner element at a position substantially spaced from the gas orifice, said gas igniter being positioned to selectively ignite the flow of gas.

5. The cooking appliance according to claim 4, further comprising: a igniter shield disposed about and covering the gas igniter.

6. The cooking appliance according to claim 1, wherein the gas orifice defining member is separately fixed to each of the gas burner element and the base to ensure the desired alignment between the gas burner element and the gas orifice.

7. The cooking appliance according to claim 1, further comprising: a first attachment bracket for securing the gas burner element to the base.

8. The cooking appliance according to claim 7, further comprising: a second attachment bracket securing the gas orifice defining member to the base to establish the desired alignment.

9. The cooking appliance according to claim 8, wherein the gas burner element is also fixedly secured to the base at a location spaced from the first attachment bracket.

10. The cooking appliance according to claim 9, further comprising: a third attachment bracket for fixedly securing the gas burner element to the base at the location spaced from the first attachment bracket.

11. The cooking appliance according to claim 1, further comprising: a pair of locating notches arranged along respective edge portions of the base, said notches being adapted to at least partially support a rear portion of the burner module within the oven cavity.

12. The cooking appliance according to claim 11, further comprising: a pair of tab elements projecting from the base, said tab elements being adapted to support a false bottom panel within the oven cavity.

13. The cooking appliance according to claim 1, wherein the gas burner module further includes an integrated gas supply line including a first end which is adapted to interconnect with a main supply, and a second end terminating at the gas orifice.

14. A gas burner module for use in a gas cooking appliance comprising:

a base;

a gas burner element including a gas inlet portion and a plurality of exit openings arranged along a surface of the gas burner element; and a gas orifice defining member having a gas orifice adapted to receive a flow of gas from a gas source, each of said gas burner element and said gas orifice defining member being fixedly secured to the base in a manner which maintains a desired alignment between the gas burner element and the gas orifice for efficient combustion of gas, wherein the gas orifice defining member is separately fixed to each of the gas burner element and the base to ensure the desired alignment between the gas burner element and the gas orifice.

15. The gas burner module according to claim 14, further comprising: a gas igniter secured to the gas burner element at a position substantially spaced from the gas orifice, said gas igniter being positioned to selectively ignite the flow of gas.

16. The gas burner module according to claim 15, further comprising: a igniter shield disposed about and covering the gas igniter.

17. The gas burner module according to claim 14, further comprising: a first attachment bracket securing the gas burner element to the base.

18. The gas burner module according to claim 14, wherein the gas burner module further includes an integrated gas supply line including a first end which is adapted to interconnect with a main supply, and a second end terminating at the gas orifice.

19. A gas burner module for use in a gas cooking appliance comprising:

a base;

a gas burner element including a gas inlet portion and a plurality of exit openings arranged along a surface of the gas burner element;

a gas orifice defining member having a gas orifice adapted to receive a flow of gas from a gas source, each of said gas burner element and said gas orifice defining member being fixedly secured to the base in a manner which maintains a desired alignment between the gas burner element and the gas orifice for efficient combustion of gas;

a first attachment bracket securing the gas burner element to the base; and a second attachment bracket for securing the gas orifice defining member to the base to establish the desired alignment.

20. The gas burner module according to claim 19, wherein the gas orifice defining member is separately fixed to each of the gas burner element and the base to ensure the desired alignment between the gas burner element and the gas orifice.

21. The gas burner module according to claim 19, wherein the gas burner element is also fixedly secured to the base at a location spaced from the first attachment bracket.

22. The gas burner module according to claim 21, further comprising: a third attachment bracket for fixedly securing the gas burner element to the base at the location spaced from the first attachment bracket.

23. A gas burner module for use in a gas cooking appliance comprising:

a base;

a gas burner element including a gas inlet portion and a plurality of exit openings arranged along a surface of the gas burner element;

a gas orifice defining member having a gas orifice adapted to receive a flow of gas from a gas source, each of said gas burner element and said gas orifice defining member being fixedly secured to the base in a manner which maintains a desired alignment between the gas burner element and the gas orifice for efficient combustion of gas; and a pair of locating notches arranged along respective edge portions of the base, said notches being adapted to at least partially support the burner module within an oven cavity.

24. The gas burner module according to claim 23, further comprising: a pair of tab elements projecting from the base, said tab elements being adapted to support a false bottom within the oven cavity.

25. A method of assembling a gas burner in an oven of a cooking appliance comprising:

pre-assembling a gas burner module by:

securing a gas burner element to a base structure; and separately securing a gas orifice defining member, having a gas orifice aligned with the gas burner element in order to direct a flow of gas through the gas orifice and into the gas burner element, to the base structure; and mounting the gas burner module as an integrated unit in the oven.

26. The method of claim 25, wherein the gas burner module is pre-assembled by separately fixing the gas orifice defining member to each of the gas burner element and the base structure to ensure the desired alignment between the gas burner element and the gas orifice.

27. The method of claim 25, wherein the gas burner module is further pre-assembled by mounting a gas igniter to the gas burner element at a position substantially spaced from the gas orifice.

28. The method of claim 25, wherein the gas burner module is further pre-assembled by incorporating a gas supply line into the gas module, with a first end of the gas supply line being adapted to be interconnected with a main supply and a second end of the gas supply line terminating at the gas orifice.

29. The method of claim 25, wherein the gas burner module is further pre-assembled to incorporate rear locating notches on the base structure and wherein the gas burner module is mounted in the oven through the notches.

30. The method of claim 25, wherein the gas burner module is further pre-assembled to incorporate a plurality of apertured flanges about the base structure and wherein the gas burner module is mounted in the oven through the apertured flanges.

* * * * *